US005140925A

United States Patent [19]

Tyring

[11] Patent Number: 5,140,925

[45] Date of Patent: Aug. 25, 1992

[54] ARRANGEMENT IN GENERAL CARGO SHIPS HAVING SIDE PORT OPENINGS

[75] Inventor: Per A. Tyring, Hop, Norway

[73] Assignee: Kristian gerhard jebsen skipsrederi A/S, Fyllingsdalen, Norway

[21] Appl. No.: 623,753

[22] PCT Filed: Apr. 20, 1990

[86] PCT No.: PCT/NO90/00071

§ 371 Date: Jan. 7, 1991

§ 102(e) Date: Jan. 7, 1991

[87] PCT Pub. No.: WO90/12729

PCT Pub. Date: Nov. 1, 1990

[30] Foreign Application Priority Data

Apr. 26, 1989 [NO] Norway ..... 891722

[51] Int. Cl.[5] ..... B63B 25/02

[52] U.S. Cl. ..... 114/73; 212/190; 414/141.5

[58] Field of Search ..... 114/72, 73, 75; 212/190, 191; 414/139, 144, 141.5

[56] References Cited

U.S. PATENT DOCUMENTS 2,988,036 6/1961 Mooneyhan et al. ..... 114/72

4,803,940 2/1989 Ebeling et al. ..... 114/72

*Primary Examiner*—Jesus D. Sotelo

*Attorney, Agent, or Firm*—Francis C. Hand

[57] ABSTRACT

A cargo ship (10) is equipped with side port openings (34,35) for transporting freight (59) inwardly and outwardly from the ship. The ship (10) is equipped with an upper superstructure (25) in a continuous length above a fore-and-aft row of upwardly opening holds (11a-11f). The holds have maximum hatchways. There is defined in the superstructure a common, shielding transport compartment (33) for the holds which permits movement of a transport arrangement (36,37) with freight (58) fore-and-aft and transversely a distance above the holds and via a locally defined side port opening (34).

3 Claims, 3 Drawing Sheets

ARRANGEMENT IN GENERAL CARGO SHIPS HAVING SIDE PORT OPENINGS

The present invention relates to an arrangement in ships, especially general cargo ships, equipped with side port openings for transporting freight inwardly into and outwardly from the ship.

In connection with the loading and unloading of ships via side port openings it is customary to handle the freight in several successive operations, for example by handling the freight with fork lift trucks on quays and with separate hoisting equipment for handling freight from quay to ship and in certain regions internally in the ship and with fork lift trucks or other transport arrangements in remaining regions internally in the ship. It is an appreciable problem that the freight must be put down between transfer from transport means to transport means and must be grasped and handled with various equipment and thereby the freight can be exposed to unnecessary damage during the transport transfer between ship and quay.

Accordingly, it is an object of the invention to be able to handle freight in one single continuous transport operation with one and the same transport system.

It is another object of the invention to move freight exclusively by way of rectilinear movements and in a precisely controlled manner with one and the same transport system from a quay directly into position in a ship or from a position in a ship directly into position on a quay.

In particular the objective is to be able to handle units of freight so that on loading, the freight can be put down at precisely established locations in the hold according to a set control program, or so that on unloading the freight can be fetched again from corresponding precisely established locations in the hold for unloading in a predetermined sequence directly into place at the unloading location.

The arrangement according to the invention is characterised in that the ship is equipped with an upper superstructure in a continuous length over a fore-and-aft row of upwardly opening holds, which have maximum hatch openings, for defining a common, shielding transport space which allows movement of a transport arrangement with freight fore-and-aft and tranversely a distance above the holds and via a locally defined side port opening or a small number of locally defined side port openings to and from the ship.

By means of superstructure there is the possibility of providing an effective transport system for serving the holds one after the other with one and the same set of transport means, for example via one and the same side port opening. Alternatively two or more sets of such transport means can be employed for serving their respective groups of holds via a number of side port openings adapted for this. By this there is the possibility of allowing the transport of freight to and from the ship to be carried out in a simple and effective manner internally in the ship, with effective protection agains weather and wind and with loading hatches to the different holds open to the maximum.

The arrangement is further characterised in that at the under side of the superstructure there is fastened a first set of a fore-and-aft transport rails for the support of a first fore-and-aft running transport means, that the first transport means is equipped with a second set of transverse transport rails for the support of the second transverse running transport means, which can be moved from a position within the superstructure to a position projecting partly outside the ship via associated side port openings, that the second transport means is equipped with a third set of transverse transport rails for the support of a third transport means, which can be moved from an inner position to an outer position on the second transport means and which is equipped with a hoist for lifting and lowering freight relative to the third transport means.

By means of the afore-mentioned transport system a simple, rectilinear movement of the freight can be ensured, controlled by the transport means and the hoist one after the other, for handling the freight in a gentle and accurate manner, determined by simple paths of movement of the transport means and the hoist.

In addition the arrangement is characterised in that the first set of transport rails is placed at transverse outer sides of the superstructure with the first transport means moveable in the space between the rails, that the first and second transport means and the second set of transport rails form a loading and unloading arrangement known per se extendable telescopically in a transverse direction, and that the third transport means is formed in a manner known per se by a travelling crab which is displaceable along the third set of transport rails.

Further features of the invention will be evident from the following description having regard to the accompanying drawings, in which.

Figure 1:
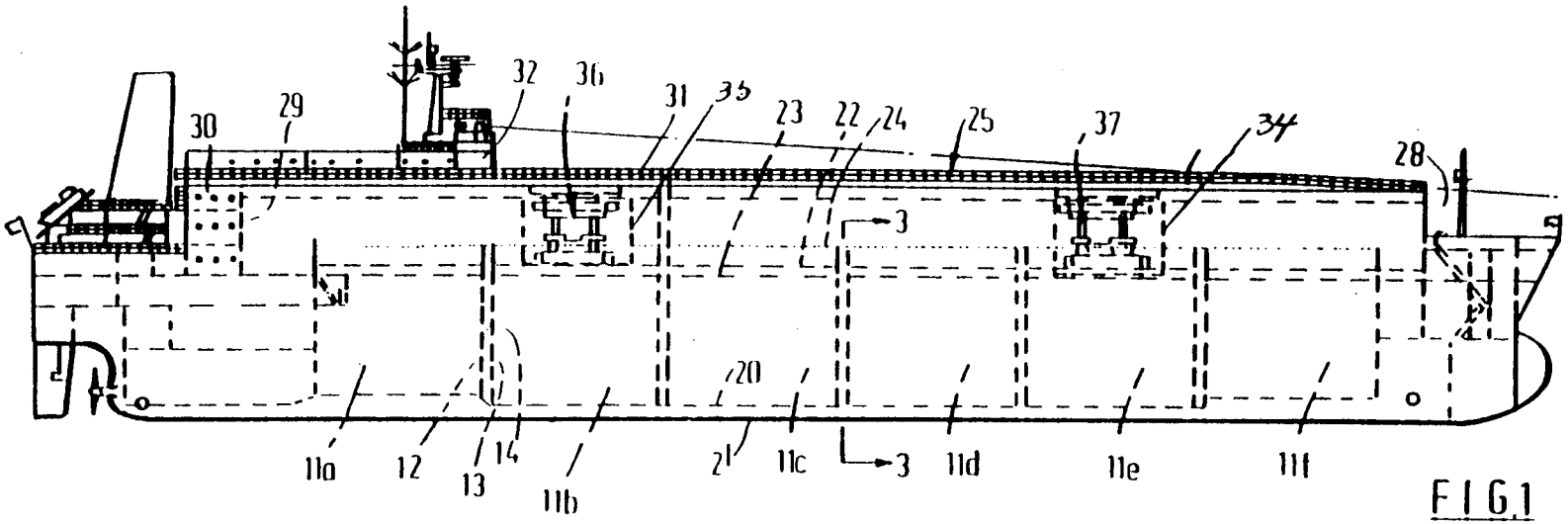
FIG. 1 shows a ship according to the invention, illustrated in side elevation.
Figure 2:
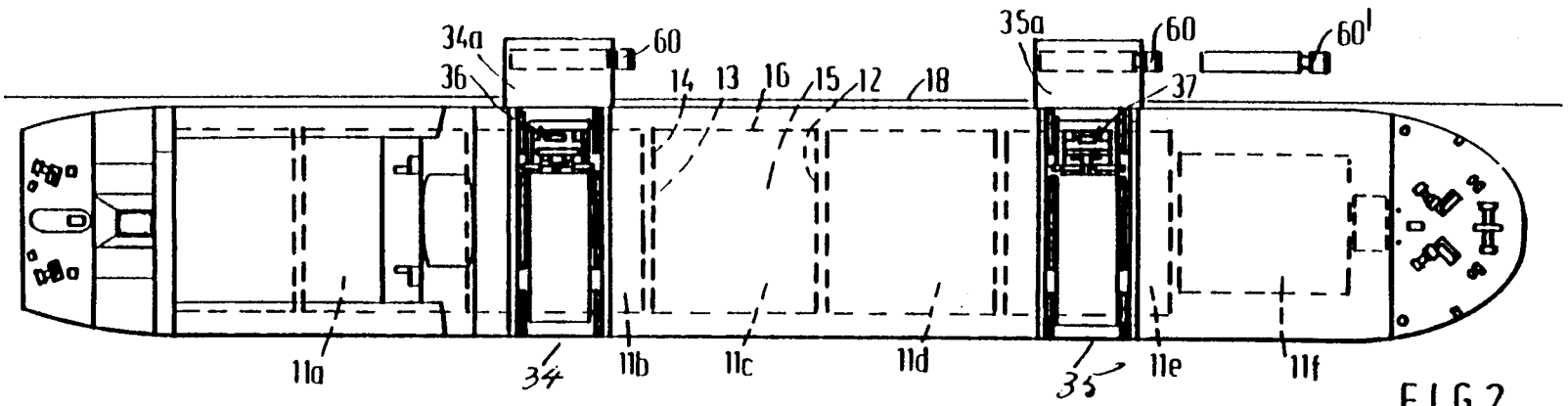
FIG. 2 shows the same as in FIG. 1 illustrated in plan elevation.

Referring to FIGS. 1 and 2, the general cargo ship 10 has a number (six) of separate holds 11*a*-11*f* which succeed each other in the fore-and-aft direction and which are separated from each other by means of pairs of transverse partition bulk heads 12 and 13 and an intermediate hollow compartment 14.

Each hold in the illustrated embodiment is provided with a freight hatch opening 15 which stretches over the whole length and breadth of the hold. Each hold is defined fore-and-aft between two oppositely disposed partition bulkheads 12,13 and is defined transversely between two side bulkheads 16,17 which are placed just within a respective included side 18 and 19 of the ship. The holds are shown having optimum depths and extend from an inner bottom 20, which is placed a distance above a bottom 21 of the ship, to the top of a freight hatchway coaming 22 which projects a distance upwardly above a main deck, that is to say intermediate deck 23 of the ship. Just above the hatchway coaming 22 there is shown a dismountable fence 24 for enclosing freight which projects upwardly above the hatchway coaming 22.

Figure 3:
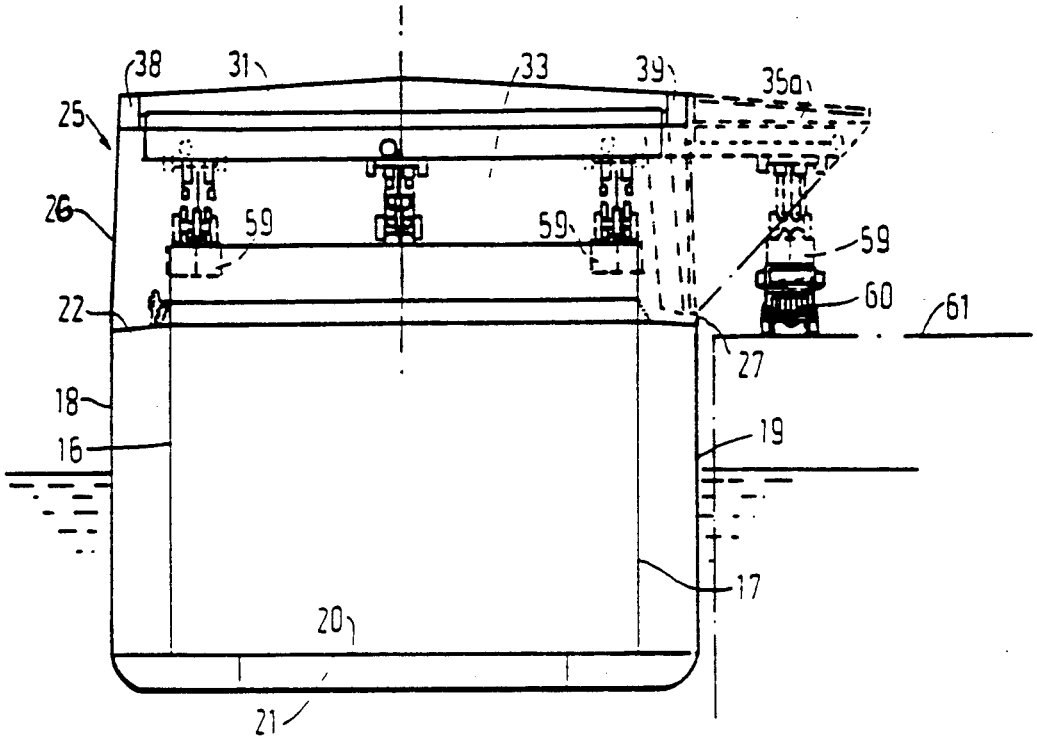
FIG. 3 shows a cross-section along the line 3—3 of FIG. 1.
Figure 4:
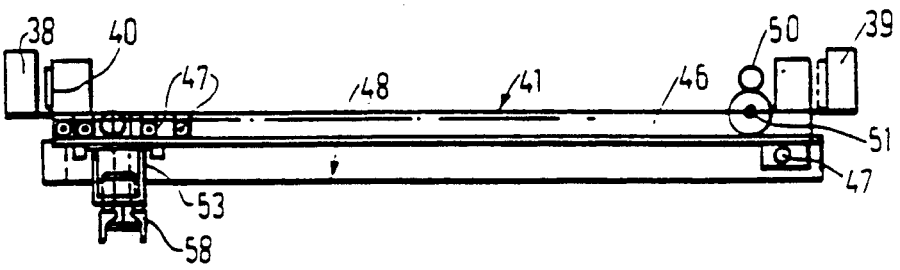
FIG. 4 shows in side elevation details in the transport means illustrated in a collapsed telescopic position.

Referring to FIG. 3, the ship 10 also has a superstructure 25; which projects upwardly from the deck 22 over the major portion of the longitudinal dimension of the ship. More specifically, the superstructure has sides 26,27 which extend flush with the sides 18,19 of the ship and a forward bulkhead 28 (see FIG. 1) just by the bow of the ship together with a rear bulkhead 29 at the stern of the ship or in the leading edge of a conventional ship's construction 30. On the top of the superstructure is present a shelter deck 31 and in the rear edge of the deck 31 is present a bridge construction 32. By means of the superstructure 25 there is formed a large, continuous, common transport compartment 33 (see FIG. 3) above the row of holds 11*a*-11*f*. The superstructure 25 is adapted to provide effective cover and shielding of the holds 11*a*-11*f* at the same time as a transport compartment is provided with the abundant possibility of movement for an effective transport arrangement or several cooperating transport arrangements for moving freight internally in the ship. Referring to FIG. 1, two side port openings 34 and 35 are provided on one side 26 of the superstructure (equivalent side port openings not shown further can be placed on the opposite side of the superstructure) so that freight can be conveyed inwardly into or outwardly from the ship in a movement which is connected to the movements internally in the ship. There are shown (FIG. 1 and 2) two separate transport arrangements 36,37 which can be served via their respective side port openings 34,35.

The transport arrangements comprise, as shown in FIGS. 4–7, a first pair of fore-and-aft transport rails 38,39 (such as shown in FIG. 3) which are fastened to a respective one of the sides 26,27 of the superstructure 25 up under the deck 31. The rails are preferably common rails for both transport arrangements, so that each of the transport arrangements can overlap as required by the pattern of movement for the remaining transport arrangement. In each transport arrangement, there can be supported on rails 38,39 by means of traversing wheels 40 a first transport means or carriage 41, which is moveable longitudinally along the rails 38,39 by means of a rack and drive motor with associated drive gear wheels (not shown further).

Figure 6:
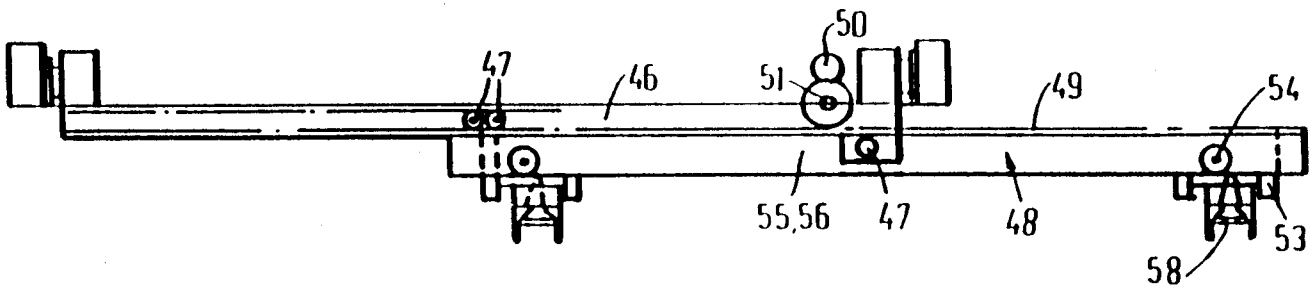
FIG. 6 shows in side elevation the same as in FIG. 4, illustrated in a pushed out telescopic position.
Figure 7:
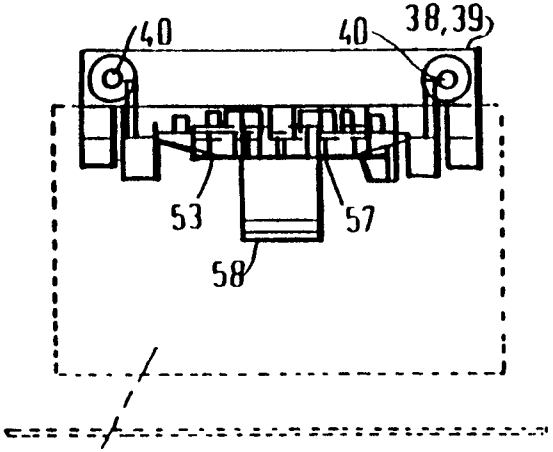
FIG. 7 shows an end elevation of FIG. 5.

On the carriage 41 there is fastened another pair of transverse transport rails 45,46 (see FIG. 6). On the rails 45,46 there is supported by means of traverse wheels 47 a second transport means or carriage 48 which together with the carriage 41 form a telescopically displaceable transport arrangement. By means of a rack 49 on the carriage 48 and a drive motor 50 with associated drive gear wheels 51 the carriage can be axially displaced relative to the carriage 41 and in this way moved a distance outside the side of the ship via the associated side port opening 34 (35).

Figure 5:
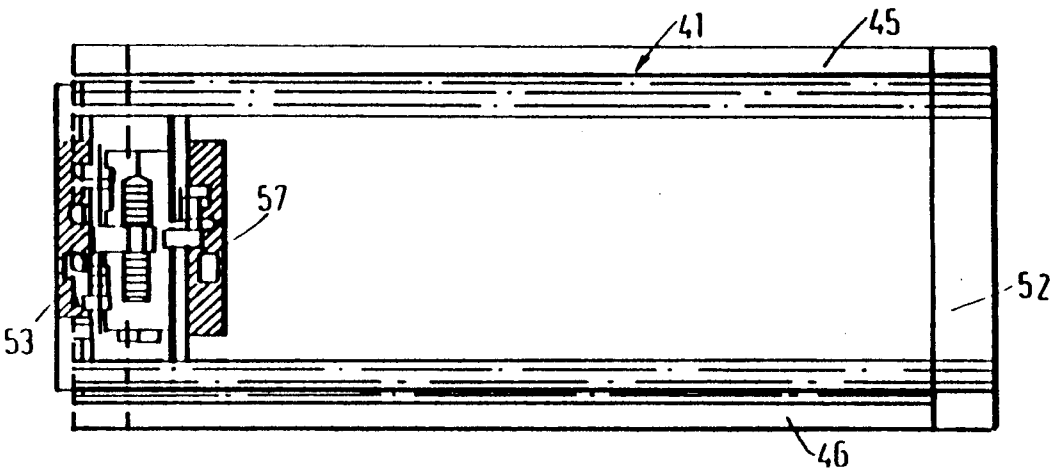
FIG. 5 shows a section of FIG. 4 illustrated in plan elevation.

The carriages 41 and 48 are placed heightwise directly above each other and are separately designed with an annular framework having an intermediate compartment 52 as shown in FIG. 5. In the hollow compartment 52, a third transport means is moveable in the form of a travelling crab 53. By means of traverse wheels 54, the travelling crab 53 is supported on a third set of transport rails 55, 56 on the carriage 48.

On the travelling crab 53 there is fastened a hoist machinery 57 for a hoist 58 for lifting and lowering of freight 59 directly to and from a vehicle 60 on a quay 61 or to and from a landing location in place in a hold (see FIG. 3).

In FIG. 2 there is indicated a vehicle 60' which leaves the loading/unloading location and two vehicles 60 below their respective loading/unloading locations just by their respective side port openings in the ship. There are indicated the associated side port doors 34*a* or 35*a* swung upwardly and outwardly to form a roof over the loading/unloading location.

In FIG. 3 there are indicated four different positions for the travelling crab 53 with associated freight 59, that is to say a first position outside the side 18 of the ship with the telescopic arrangement pushed partly outside the side of the ship and with the travelling crab 53 in the one outer position in associated second carriage 48, a second position with the telescopic arrangement pushed within the side of the ship and with the travelling crab 53 in a position corresponding to the first position, a third position with the travelling crab moved to a central position in the second carriage 48 and a fourth position with the travelling crab 53 moved to a second outer position in the second carriage.

By means of for example computer control with complete freight handling according to an established control program it is possible to direct the movements of the hoist 58, the travelling crab 53 and the two carriages 41 and 48 in an accurately controlled manner to and from the loading location from and to the unloading location as required.

I claim:

1. In combination a cargo ship having a plurality of holds disposed in a fore-and-aft direction, each hold having a hatch opening at an upper end;

a superstructure on said ship disposed over said holds, said superstructure having at least one side port opening therein for conveyance of freight therethrough; and a transport arrangement for loading and unloading freight to and from said holds through said port opening, said arrangement including a first pair of transport rails secured to said superstructure and extending longitudinally over said holds, a first carriage movable along said rails and including a second pair of rails transverse to said first pair of rails, a second carriage movably mounted on and in parallel with said first carriage to project through said port opening in an extended position relative to said first carriage, and a hoist movably mounted longitudinally of and on said second carriage for lifting and lowering freight.

2. The combination as set forth in claim 1 which further comprises a door mounted on said superstructure over said port opening for pivoting upwardly and outwardly to form a roof over a loading area.

3. The combination as set forth in claim 1 wherein said second carriage is telescopically mounted on said first carriage.

* * * * *